US005102120A

United States Patent [19]

Lindblad

[11] Patent Number: 5,102,120

[45] Date of Patent: Apr. 7, 1992

[54] HYDROTHERAPY ENHANCEMENT DEVICE

[75] Inventor: Frederick W. Lindblad, Aurora, Ill.

[73] Assignee: Ultra-Diamond Company, St. Charles, Ill.

[21] Appl. No.: 631,369

[22] Filed: Dec. 20, 1990

[51] Int. Cl.[5] ..... A63B 21/00

[52] U.S. Cl. ..... 482/111; 482/55

[58] Field of Search ..... 272/71, 96, 116; 441/56, 58–61, 63; 24/115 H, 481; 224/218, 222, 267

[56] References Cited

U.S. PATENT DOCUMENTS

| | | | |
|---|---|---|---|
| 2,832,116 | 4/1958 | Clevett, Jr. et al. | 24/115 H |
| 3,107,371 | 10/1963 | Thompson | 441/59 |
| 3,765,042 | 10/1973 | Montrella | 441/58 |
| 3,789,448 | 2/1974 | Mitchell | 441/61 |
| 4,316,300 | 2/1982 | Lewis | 441/59 |
| 4,411,422 | 10/1983 | Solloway | 272/96 |
| 4,521,011 | 6/1985 | Solloway | 272/71 |
| 4,913,418 | 4/1990 | Schlueter et al. | 272/71 |

FOREIGN PATENT DOCUMENTS

| | | | |
|---|---|---|---|
| 243675 | 11/1965 | Austria | 24/115 H |
| 2333758 | 1/1975 | Fed. Rep. of Germany | 441/56 |

*Primary Examiner*—Richard J. Apley
*Assistant Examiner*—Jerome Donnelly

[57] ABSTRACT

A hydrotherapy enhancement device having a sheet-form rigid plate member including an essentially rectangular main body portion to support the extremity of a human limb, a fastening arrangement for securing the human limb to the body portion, and fins for increasing the resistance provided to the limb upon movement of the device through water, increases the resistance incurred by the arm or leg muscles by movement of a hand or foot secured to the device within a body of water, thereby improving the strengthening effect of exercises to reduce muscle atrophy in the arm or leg muscles, without adding additional strain to the knee or elbow joints.

1 Claim, 1 Drawing Sheet

HYDROTHERAPY ENHANCEMENT DEVICE

BACKGROUND OF THE INVENTION

1. Field of the Invention

The present invention relates to a hydrotherapy enhancement device.

2. In the Prior Art

Certain conditions, such as infections of the joints and arthritis, may include painful movement of the limb or limbs in their pathology. In response, patients suffering from such conditions sometimes avoid movement of the affected limb or limbs in an effort to arrest the resulting pain thereof. The lack of movement of the limbs can lead to flexion contractures and muscle atrophy. To reduce the likelihood of these conditions, it is often recommended that exercises be performed in which little or no body weight is placed on the joints. Such exercises can be performed in a swimming pool or other body of water. However, actually improving the muscle tone of the affected limb or limbs by means of these exercises is a slow and cumbersome task. Thus, improving the quality of such exercises is an exigent concern.

While various types of paddles and fins have been provided for enhancing the propulsion of a swimmer in the water, the present invention addresses the problems attendant upon therapeutic treatment of the limbs of human patients.

SUMMARY OF THE INVENTION

The present invention provides a hydrotherapy device that increases the resistance incurred by the arm or leg muscle groups when moved through water, without increasing the body weight placed on a corresponding elbow or knee joint.

In one embodiment, a hydrotherapy enhancement device includes a sheet-form rigid plate member, having an essentially rectangular main body portion, on which an extremity of a human limb can be supported. The plate member can be fastened to the extremity of a human limb, and fins are integrally connected to opposite longitudinal sides of the main body portion. As a patient moves the paddle-like device through water via an extremity of a human limb, the resistance delivered to the limb is selectively and controllably increased.

The fins can be configured as a number of flanges integrally formed on opposite longitudinal sides of the main body portion. The resulting overall shape of the device provides uniform resistance to movement of a human limb, via an extremity, through a body of water.

The plate member can be attached to the extremity via at least one flexible strap having ends extending through at least one pair of apertures through the main body portion. The width of the strap exceeds the diameter of the apertures, so that the strap must be stretched to fit the apertures. The strap forms a U-shaped support above the plane of the central main portion, and can be further secured via a support plate.

The device may be used to exercise either the arm or the leg muscles. The device is worn on a hand to exercise the arm muscles and on a foot to exercise the leg muscles.

The resistance arising from the movement of the device through water is increased by the design of the paddle, and can be adjusted by increasing or decreasing the rate of movement of the paddle-like device through the water.

Advantageously, the device may be put on and taken off with ease, such that exercise therewith is readily accessible, especially for the severely disabled or those with limited use of the arms or legs.

Other objects and advantages of the present invention will be apparent upon reference to the accompanying description when taken in conjunction with the following drawings.

DESCRIPTION OF THE PRESENTLY PREFERRED EMBODIMENTS

Figure 1:
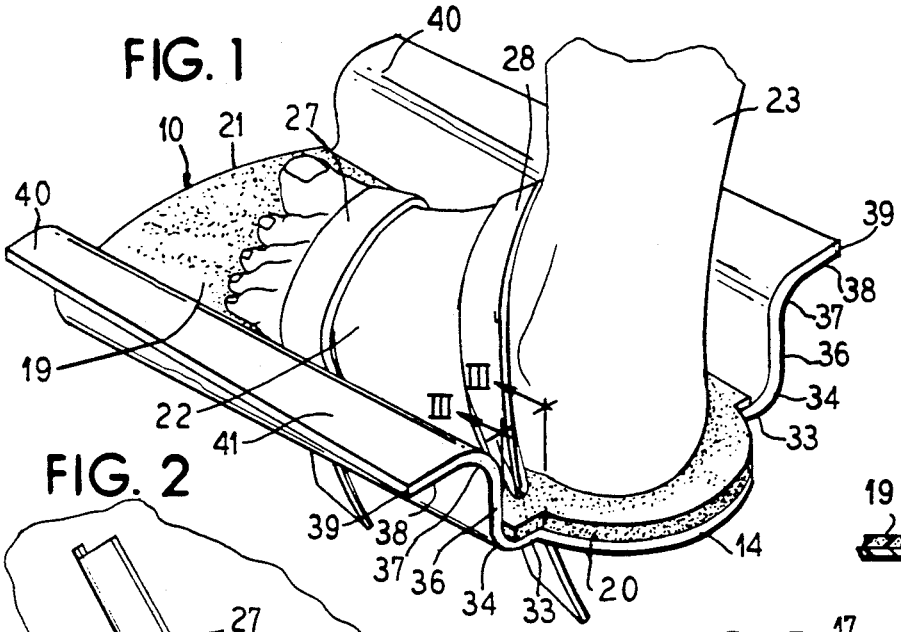
FIG. 1 is a perspective view of a hydrotherapy enhancement device constructed in accordance with the principles of the present invention, as used to exercise the muscles of the leg via a human foot.
Figure 3:
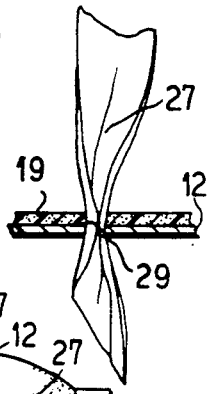
FIG. 3 is a fragmentary cross-sectional view taken on the line III—III of FIG. 1.

A hydrotherapy enhancement device is shown generally at 10 and comprises a sheet-form rigid plate member 11 bent and formed in accordance with the principles of the present invention. Although various materials such as different kinds of rust resistant metals could be used, a particularly good form of material is a rigid moldable plastic material that will retain its shape for the purposes of the present invention.

Referring to the drawings, the sheet-form member 11 has a main body portion 12 formed with a heel portion 13 which is curved outwardly at its edge extremity as at 14.

The body portion 12 extends longitudinally from the relatively narrow heel portion 13, tapering gradually to form a wider front portion 16 and terminating in a curved forwardly projecting edge 17. There is thus formed a platform providing a support surface 18. In order to cushion the support surface 18 to more comfortably seat the extremity of a limb, there is provided a flat, resilient, sponge-like and elastic pad 19 having a configuration which is generally complementary to the tapered shape of the body portion 12 and specifically the support surface 18. A correspondingly curved heel edge 20 is at one end of the pad 19 and overlies the edge extremity 14. At the opposite end, a forward edge 21 of the pad 19 curves outwardly and forwardly to overlie the forwardly projecting edge 17.

Figure 2:
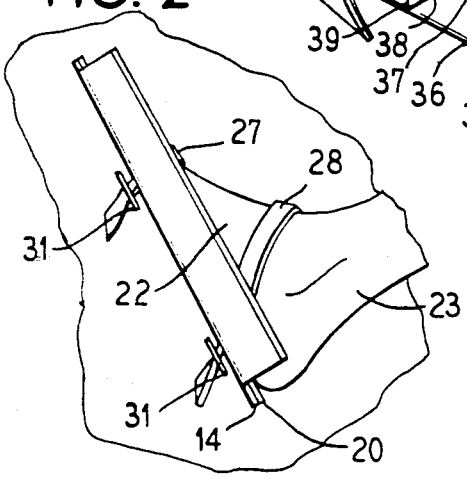
FIG. 2 is a side elevational view of the hydrotherapy device of FIG. 1.
Figure 5:
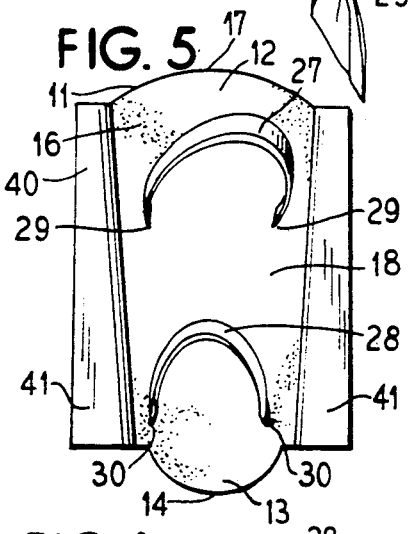
FIG. 5 is a top plan view of a hydrotherapy device constructed in accordance with the principles of the present invention.
Figure 4:
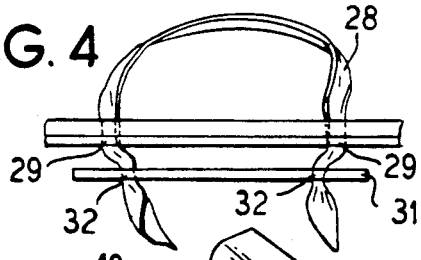
FIG. 4 is a fragmentary end elevational view of the device of FIG. 1, but showing additional details of the fastening means by which the device is retained on a limb of a user.
Figure 6:
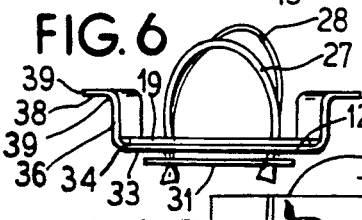
FIG. 6 is a front elevational view of the device shown in FIG. 1-5.
Figure 8:
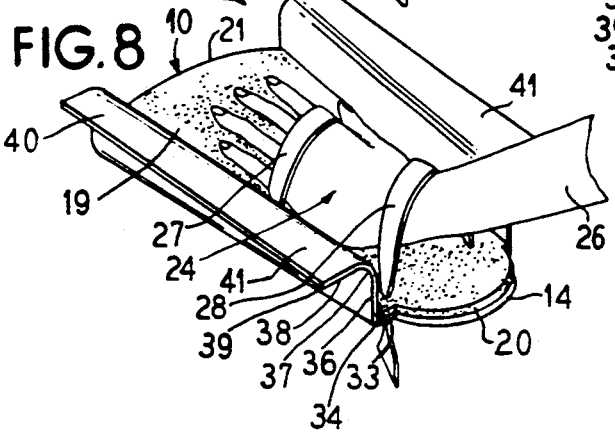
FIG. 8 is a perspective view that illustrates how to exercise the muscles of the arm, via a human hand.
Figure 7:
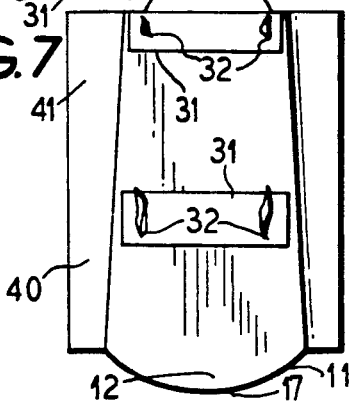
FIG. 7 is a bottom plan view.

The tapered and cushioned surface provided by the pad 19 on the support surface 18 is sized to comfortably accommodates the foot extremity 22 on the end of a leg limb 23 as shown in FIGS. 1 and 2, or should the user be therapeutically treating an arm extremity, a hand extremity 24 on the end of an arm limb 26 fits in the same space as shown in FIG. 8.

In order to securely fasten the therapy enhancement device 10 on to the hand 24 or the foot 22 of a user, suitable fastening means are provided. While various forms of fastening means are available for accomplishing the functional purpose, one form of fastening means which is particularly suited for the device shown by way of exemplification utilizes a pair of flexible elastic straps formed of rubber or a suitable rubber substitute and including a front strap 27 and a rear strap 28. The pad 19 and its underlying body portion is formed with four apertures, there being a first front pair of apertures 29,29 in laterally spaced relation to one another and disposed in the wider front portion 16.

A second pair of apertures 30,30 is formed in the narrower heel portion 13, being spaced apart from one another laterally and being spaced longitudinally from the apertures 29,29.

A thin flat locking bar 31 underlies the apertures and is itself formed with a pair of laterally spaced apertures 32,32 similar in size to the apertures 29 and 30. However, it is specifically contemplated that the aperture 32,32 not be in direct registration with either the apertures 29,29 or the apertures 30,30. Rather, the spacing dimension of the apertures 32,32 is such as to be at least a full diameter offset either inwardly or outwardly, i.e., using the diametral dimension of the apertures as the controlling variable, the apertures 32 are spaced either inwardly or outwardly relative to the apertures 29 and 30. Further, while all of the apertures 29, 30 and 32 are of the same size, it should be understood that the diameter is selected so that the elastic straps 27 and 28 can be stretched and elongated locally. The straps 27 and 28 can be threaded through the apertures, whereupon when the straps are permitted to reassume their normal unstressed condition, they will thicken and form a comparatively tight joint with the adjoining edges of the apertures.

The straps 27 and 28 can be adjusted on either the hand or the foot by stretching and elongating the strap and pulling the straps through the corresponding apertures until the user gets a good fit. The adjusted position can then be locked in place by stretching and elongating the appropriate strap 27 or 28 and moving the locking bar 31 along the length of the strap on which it is located so that it is moved up as closely as possible to the bottom of the body portion 12. When so positioned, the application of additional stress to the straps 27 and 28 by either the hand or the foot of the user will not displace the straps relative to the body portion 12 because of the locking action achieved by the locking bar 31 in retaining the portion of the straps between the locking bar 31 and the bottom of the body portion 12 in an unstressed condition.

In accordance with the present invention, the therapy enhancement device 10 is provided with special fins shaped and disposed to develop special therapeutic fluid flow characteristics when the device 10 is moved through a body of water.

The special fins may be provided by forming a special flange on each longitudinal side of the body portion 12. Except for being right hand or left hand, the fins on opposite sides of the device 10 are similar in structural details and accordingly similar reference numerals are utilized to identify the parts.

Referring to the drawings, it will be noted that the flange extends laterally outwardly of the body portion 12 along the longitudinal edge thereof. A first horizontal leg is shown at 33 which extends into a lower curved transition portion 34 merging into a vertical leg 36. The leg 36 extends vertically upwardly into an outwardly and upwardly curved upper transition portion 37 merging into an outwardly laterally extending upper horizontal leg 38 having a terminal outer edge 39.

As will be noted particularly from the bottom and top plan views of the drawings, the upper horizontal leg 38 is formed to have a narrower dimension as at 40 and tapers gradually towards a wider dimension 41 at its opposite end. The taper of the leg 38 is opposite to that of the body portion, thereby giving the therapy device a pleasing overall aesthetic appearance that is essentially rectangular in configuration.

In operation, the hydrotherapy enhancement device 10 is fastened to the hand or the foot of a user and the user employs the associated limb to move the device 10 through the water of a pool or tank or tub in which the user is obtaining hydrotherapy. As the device moves through the water, the special fins will tend to develop a special action since the adjoining body of liquid will be re-directed to flow laterally outwardly of the path of movement of the devices 10. By controlling the pace or speed with which the device is moved, the user can advantageously adjust the degree of exercise imparted to the limb and its accompanying joints without placing any body weight on the affected parts of the body.

Although minor modifications might be suggested by those skilled in the art, it should be understood that I wish to embody within the scope of the patent warranted hereon all such modifications as reasonably and properly come within the scope of my contribution to the art.

I claim as my invention:

1. A hydrotherapy enhancement device consisting of a sheet-form rigid plate member bent and formed to provide a main body portion formed with a heel portion curved outwardly at its edge extremity, said body portion extending longitudinally to form said heel portion and tapering gradually to form a wider front portion terminating in a curved forwardly projecting edge, thereby forming a platform providing a support surface, a flat, resilient, sponge-like and elastic pad having a configuration generally complementary to the tapered shape of the support surface, thereby to comfortably accommodate the foot or hand extremity of a user undergoing hydrotherapeutic treatment, fastening means for connecting the device to the extremity of the user comprising, a pair of flexible elastic straps formed of a suitable resilient material and including a front strap and a rear strap, said pad and said body portion each being formed with four apertures including, a first front pair of apertures laterally spaced relative to one another and disposed in the wider front part of said body portion, and a second rear pair of apertures formed laterally spaced relative to one another and disposed in the narrow heel portion and longitudinally spaced relative to said first front pair of apertures, a thin flat locking bar underlying each of said pairs of apertures and each of said locking bars being formed with laterally spaced apertures similar in size to the same aperture in said body portion but out of register therewith by at least a full diameter, so that the elastic straps can be adjustably stretched and elongated locally and threaded through the apertures, where upon the unstretched straps will thicken and form a tight joint with the adjoining edges of the apertures, and special fins shaped and disposed to develop special therapeutic fluid flow characteristics when a device is moved through a body of water and more specifically comprising, side flanges extending laterally outwardly of said main body portion on each side thereof, each side flange having, a first horizontal leg extending into a lower curved transition portion and merging into a vertical leg extending upwardly into an outwardly and upwardly curved upper transition portion merging into an outwardly laterally extending upper horizontal leg having an outer terminal edge, said upper horizontal leg being formed to have a narrower dimension at the wider front portion of said main body portion and tapering gradually towards a wider dimension at its opposite end corresponding to the narrow heel portion of said main body portion, whereby a user can advantageously adjust the degree of exercise imparted to the limb by controlling the pace by which the device is moved through the water.

* * * * *